United States Patent [19]

Ladewski

[11] 4,448,392

[45] May 15, 1984

[54] THREAD STOP FOR A SCREW JACK

[75] Inventor: Bernard F. Ladewski, St. Joseph, Mich.

[73] Assignee: Auto Specialties Manufacturing Company, St. Joseph, Mich.

[21] Appl. No.: 342,070

[22] Filed: Jan. 25, 1982

[51] Int. Cl.[3] ..... B66F 3/18

[52] U.S. Cl. ..... 254/103; 411/360; 411/334

[58] Field of Search ..... 74/424, 8 R, 89, 15; 411/333, 334, 360, 362; 254/98, 103, 102

[56] References Cited

U.S. PATENT DOCUMENTS

| | | | |
|---|---|---|---|
| 707,730 | 8/1902 | Storrs | 254/103 |
| 1,116,253 | 11/1914 | Eaton | 411/334 |
| 1,247,255 | 11/1917 | DiFrancesco | 411/334 |
| 1,289,422 | 12/1918 | Farnes | 411/333 |
| 1,575,166 | 3/1926 | Johnson et al. | 254/103 |
| 1,760,436 | 5/1930 | Peteler . | |
| 1,929,262 | 10/1933 | Shire . | |
| 2,096,022 | 10/1937 | Akins . | |
| 2,096,050 | 10/1937 | Lucker . | |

FOREIGN PATENT DOCUMENTS

| | | | |
|---|---|---|---|
| 23971 | of 1892 | United Kingdom | 411/333 |

*Primary Examiner*—Robert C. Watson

*Attorney, Agent, or Firm*—Trexler, Bushnell & Wolters, Ltd.

[57] ABSTRACT

A thread stop is provided for a screw jack including at least one elongated, substantially cylindrical screw member having an external thread. The thread stop comprises at least one radially outwardly deformed part in a predetermined portion of a minor diameter of said external thread. This formed part is formed by a method including ductilely outwardly deforming a predetermined portion of a minor thread diameter of the external thread, so as to retain the hardness of the deformed portion substantially similar to that of the remainder of the screw member.

8 Claims, 6 Drawing Figures

THREAD STOP FOR A SCREW JACK

BACKGROUND OF THE INVENTION

The invention is directed to an improved thread stop for a screw jack and a method of forming such a thread stop.

Screw jacks for use with trucks and like vehicles are well known in the art. Such screw jacks must be efficient and safe while relatively low in cost to find acceptance in the modern marketplace. Such screw jacks are generally of the telescoping variety, and include a housing and a screw member carried at least partially within the housing for extensive and retractive or telescoping motion. Generally, a pinion gear is journaled in the housing to turn a crown gear connected to the screw member in order to cause the desired telescoping, jacking motion.

Many advances have heretofore been made in minimizing the cost and complexity of the components of such screw jacks, as well as simplifying the assembly thereof so that screw jacks of this type can be provided at a minimum, competitive cost. However, there remains room for further improvement.

For example, telescoping screw jacks of this variety require some mechanism providing a stop or mechanical limit to the telescoping extension thereof. This is necessary to prevent the jack mechanism from being overextended and inadvertently disassembled while in use. Heretofore, such thread stops have taken various forms. For example in U.S. Pat. No. 1,760,436 to Peteler, a cross pin is provided through a minor thread diameter of the screw member to engage the cooperating, telescoping tubular housing portion, and thereby prevent overextension thereof. Such pins may take the form of set screws or the like set into a sidewall of the screw member. The stop thus fills in a portion of a minor thread diameter to prevent further threadable relative movement between the external threads of the screw member and internal threads of a cooperating telescoping tubular member. It will be recognized that this type of stop requires that the screw member be drilled and tapped to receive the pin or set screw, and a suitable pin or set screw separately provided and inserted properly during the assembly of the screw jack. Hence, care must be taken during assembly of such a screw jack to ensure that these operations are properly carried out. Such extra parts and assembly steps inevitably add to the cost of production of such screw jacks.

The prior art has also proposed the use of a weldment to fill in a part of a minor thread diameter of the screw member in place of such a pin or set screw. However, such a weldment results in an area of relatively harder material in the screw member which may cause wear and damage to the cooperating internal threads of the telescoping tubular member over repeated operations. As an alternative to either a pin or set screw or a weldment, a shearing displacement of the major thread diameter has also been proposed. However, it has been found that the sheared material also presents a relatively abrasive surface to the cooperating internal threads of the telescoping tubular member, which can cause damage in operation. Moreover, the shearing has proven relatively difficult to reliably carry out, since the threads tend to become damaged or even broken during the shearing operation and, in many cases, this results in a non-useable screw member, which must be discarded.

OBJECTS AND SUMMARY OF THE INVENTION

Accordingly, it is an object of the present invention to provide a novel and improved thread stop for a screw member in a screw jack, which avoids the problems of the prior art.

A related object is to provide such a thread stop which is relatively simple and inexpensive to provide and yet highly reliable in operation.

A further object is to provide a novel and improved method for producing such a thread stop.

Briefly, and in accordance with the foregoing objects, the invention provides a thread stop for a screw jack including at least one elongated, substantially cylindrical screw member having an external thread. The thread stop comprises at least one radially outwardly deformed part in a predetermined portion of a minor diameter of the external thread. This formed part is formed by the method of the invention which comprises ductilely outwardly deforming a predetermined portion of a minor thread diameter of the external thread, so as to retain the hardness of the deformed portion substantially similar to that of the remainder of said screw member.

BRIEF DESCRIPTION OF THE DRAWINGS

Other objects, features and advantages of the invention will become more readily apparent upon reading the detailed description of the illustrated embodiment, together with reference to the accompanying drawings, wherein.

DETAILED DESCRIPTION OF THE ILLUSTRATED EMBODIMENT

Figure 1:
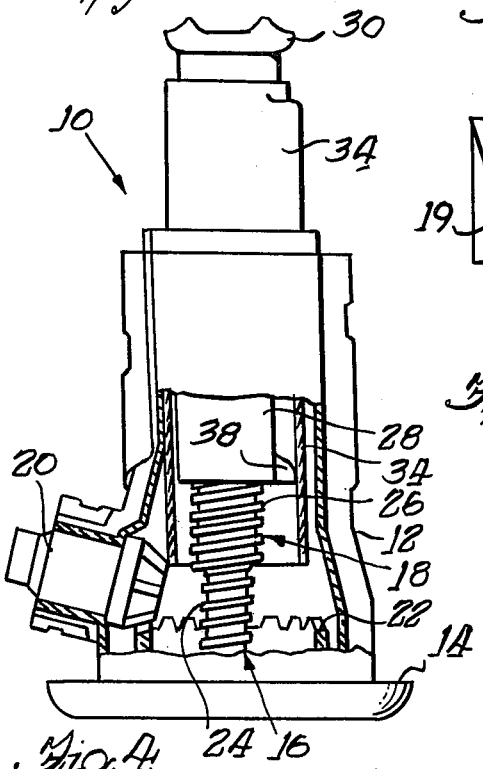
FIG. 1 illustrates a typical screw jack, partially broken away and partially in section in conjunction with which the present invention is useful.

Referring now to the drawings, and initially to FIG. 1, there is seen a typical screw jack designated generally by the reference numeral 10. Conventionally, this screw jack 10 includes a housing 12 affixed to a base plate 14 which is horizontally extended to provide a firm supportive base or foundation upon underlying pavement or ground. The housing member 12 carries screw members 16, 18 adapted for extension or retraction relative to the housing 12.

The jack 10 is operated by a handle (not shown) which is adapted to engage and rotate a pinion gear 20. This pinion gear 20 in turn rotates a crown gear 22 which is mounted as by a bearing (not shown) upon the base plate 14. This crown gear 22 in turn drives the screw member 16 which is non-rotatably affixed thereto by suitable means (not shown). This screw 16 is provided with external or male threads 24 which engage internal or female threads (not shown) formed over at least a portion of the second screw member 18. As will be seen later, this screw member 18 comprises an elongate tubular, and preferably cylindrical, member having an external thread 26.

In similar fashion, to the threads 24 of the screw 16, this latter, external or male thread 26 of the second screw member 18 engages an internal or female thread (see FIG. 3) carried internally of a cylindrical screw tube 28. At the top of the screw tube 28 a suitable lift pad 30 is provided for engaging a specific part or parts of an automobile or other vehicle to provide vehicle lifting.

In accordance with conventional practice, the screw tube 28 and screws 16, 18 cooperate to effect a telescoping motion for both lifting and lowering the jack 30, in response to the two directions of rotation of the pinion gear 20.

Figure 3:
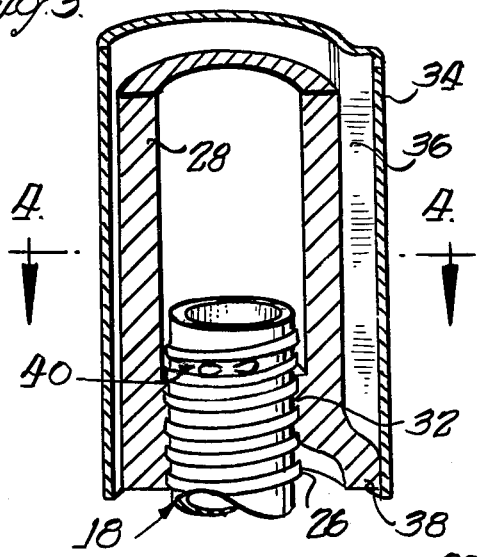
FIG. 3 illustrates a portion of the screw jack of FIG. 1 partially in section, and provided with a novel thread stop in accordance with the invention.

Referring now to FIG. 3, it will be seen that the screw member 18 is a substantially cylindrical, hollow member having external or male threads 26, as previously described. These external or male threads 26 engage a complementary internally threaded lower portion 32 of the telescoping tube member 28. In accordance with preferred practice, a further sleeve 34 is provided for slidably receiving the telescoping tube member 28. Moreover, this sleeve 34 is provided with a keyway 36 which receives a complementary key or projection 38 on the tube 28 so as to slidably but nonrotatably mount the tube 28 to the sleeve 34.

Figure 2:
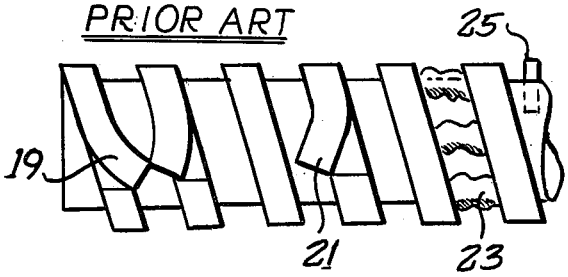
Fig. 2. PRIOR ART
FIG. 2 illustrates several prior art thread stops and a method of providing these thread stops.

As mentioned previously, the prior art, as shown in FIG. 2, proposed several forms of thread stops for the screw 18. Such stops were provided either by shearing (19, 21), by weldments (23) or by pins (25). The problems involved with such arrangements have been discussed hereinabove.

In accordance with the present invention a novel and improved thread stop, designated generally by the reference numeral 40, is provided in the external threads 26 of the screw member 18. Preferably, the stop 40 is carried relatively closely spaced to the uppermost end of the screw member 18, as viewed in FIG. 3. Accordingly, the stop 40 is arranged to engage the internal threads 32 of the sleeve 28 when the sleeve is advanced sufficiently upwardly with respect to the screw 18. In this way, further upward or telescoping motion between the tube 28 and screw 18 is precluded, thus preventing over-advancement of the screw jack 10.

Figure 4:
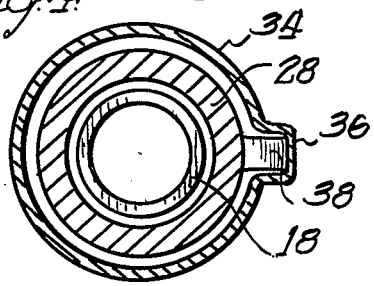
FIG. 4 is a view taken generally along the line 4—4 of FIG. 3.

Referring briefly to FIG. 4, the above-described relationship between the screw member 18, tube member 28 and sleeve 34, including the key 38 and keyway 36 is illustrated in section as indicated generally by the line 4—4 in FIG. 3.

Figure 5:
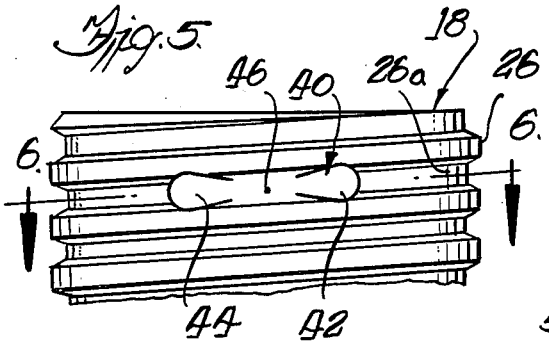
FIG. 5 is an enlarged view of a portion of a screw member provided with a thread stop in accordance with the invention.

In accordance with a feature of the invention, the thread stop 40 is located in a minor thread diameter of the external thread 26 of the screw member 18. As best viewed in FIG. 5, this thread stop 40 comprises a generally radially outwardly protruding portion of the minor thread diameter **26*a*. In accordance with the invention this outwardly deformed part 40 is formed by a ductile movement of material of the minor thread diameter 26*a*. Hence, the material of the thread stop 40 is of a substantially like or similar hardness as the material of the screw member 18** from which it is deformed by this ductile, outward movement of material.

In accordance with a preferred form of the invention, this thread stop 40 comprises at least one nib 42 having a substantially continuously, curved radially outer surface, so as not to present an abrasive or potentially damaging surface to the internal threads 32 of the tube 28. Preferably, a second, similar nib 44 is also provided, having a similar, continuously curved, radially outer surface. In accordance with a preferred form of the invention these two nibs 42, 44 are formed substantially symmetrically about an imaginary point 46 in the minor thread diameter **26*a***.

Figure 6:
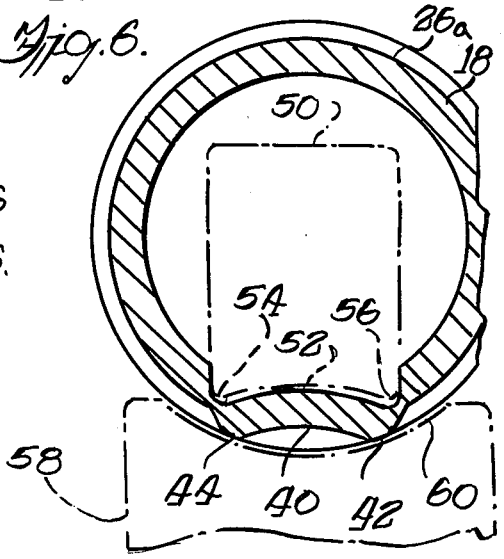
FIG. 6 is a sectional view taken generally on the line 6—6 of FIG. 5 and illustrating one method of forming a thread stop in accordance with the invention.

Reference is next invited to FIG. 6, wherein a preferred form of the method of the invention is illustrated. In accordance with the method of the invention, the thread stop 40 comprising the nibs 42, 44 is preferably formed by placing a suitable tool 50, indicated in phantom line, within the hollow interior portion of the tubular screw member 18. Preferably, this tool 50 includes a working surface or portion 52 which presents a generally concave face to the inner surface of the tubular screw member 18. Moreover, this working surface 52 defines curved side edges 54, 56 which are of substantially similar curvature to the curved protruding portions of the nibs 42 and 44.

This tool working surface 52 is placed substantially aligned with a given portion of the minor thread diameter **26*a* which is to be outwardly deformed to define the thread stop 40. Cooperatively, a second tool 58, also indicated in phantom line, is placed in contact with the external curvature, and hence, with the major thread diameter of the screw member 18. In accordance with the invention, this second tool 58 includes a working surface or face 60 which is substantially concavely curved to complement the exterior surface of the major thread diameter of the threads 26 on the screw member 18. Hence, this concave tool face or working surface 60 cooperates with the tool face or working surface 52 of the tool 50 to cause the ductile displacement of material of the minor thread diameter 26*a* to form the nibs 42, 44**.

Any suitable drive means (not shown) may be coupled with the tools 50 and 58, to achieve inward compression thereof so as to drive the material of the inner thread diameter **26*a* outwardly towards the concave tool face 60. This causes a ductile movement or deformation of the material of the screw thread 26*a*, to form the curved protruding surfaces of the thread stop 40, and preferably comprising the symmetrically formed nibs 42, 44**.

Advantageously, as mentioned above, this ductilely displaced material forming the nibs 42 and 44 presents a relatively smooth surface, of substantially the same hardness as the remainder of the screw member 18, to the internal threads 32 of the tube 28. Hence, the desired stop action is achieved while minimizing the risk of damage to the threads 32 of the tubular member 28. Moreover, as viewed in FIG. 5, it will be noticed that the nibs 42, 44 are preferably located relatively near the uppermost end of the screw member 18 and in accordance with one form of the invention may be located in the first full course or revolution of the minor thread diameter **26*a*, to permit maximum extension or telescoping of the jack 10**.

What has been shown and described herein is a novel thread stop for a screw jack. While the invention has been disclosed with reference to a preferred embodiment, the invention is not limited thereto. Those skilled in the art may devise various alternatives, changes and modifications upon reading the foregoing descriptions. The invention therefore includes such alternatives, changes and modifications insofar as they fall within the spirit and scope of the appended claims.

The invention is claimed as follows:

1. A thread stop for a screw jack including at least one elongated, substantially cylindrical hollow metal screw member having an external thread, said thread stop comprising: metal screw member material being deformed radially outwardly from the hollow screw member interior in a predetermined portion of a minor diameter of said external thread, said at least one deformed metal formation being formed by a ductile movement of screw member material and having substantially the same hardness as said screw member, the deformed metal formation comprising a pair of nibs each having a substantially continuous, curved radially outer surface and being substantially symmetrical one with the other about a predetermined point in said minor thread diameter.

2. A thread stop according to claim 1 wherein said at least one deformed formation comprises at least one nib having a radially outer surface of substantially continuous curvature.

3. A thread stop according to claim 1 wherein said deformed formation is located near an axially outer end of said elongate screw member.

4. A thread stop according to claim 3 wherein said deformed formation is located in a first full revolution of said minor thread diameter adjacent an axially outer end of said elongate screw member.

5. A thread stop according to claim 3 wherein at least a radially outermost portion of said deformed formation is of substantially the same radial extent as the major thread diameter of said external thread.

6. A screw jack comprising: telescoping means including at least one elongate tubular member having an internal thread, a substantially cylindrical, elongate hollow screw member having an external thread engageable with said internal thread, drive means for rotating said screw member to effect telescoping motion of said cylinder with respect thereto, and thread stop means on said screw member for defining a maximum extent of the said telescoping motion, said thread stop comprising screw member material which has been radially outwardly deformed from the hollow screw member interior in a predetermined portion of a minor diameter of the external thread of said screw member, said deformed material formation being formed by a ductile movement of screw member material and having substantially the same hardness as the undeformed material of said screw member, the deformed formation comprising a pair of nibs each having a radially outer surface of substantially continuous curvature, said pair of nibs being substantially symmetrical about a predetermined point in said minor thread diameter.

7. A screw jack according to claim 6 wherein said deformed formation is located near an axially outer end portion of said screw member.

8. A screw jack according to claim 7 wherein a radially outermost portion of said deformed formation is substantially the same radial extent as the major thread diameter of said screw member.

* * * * *